United States Patent [19]

Riddle

[11] 4,044,716

[45] Aug. 30, 1977

[54] VACUUM SLOT COATING APPARATUS

[75] Inventor: Dennis L. Riddle, Spartanburg, S.C.

[73] Assignee: Milliken Research Corporation, Spartanburg, S.C.

[21] Appl. No.: 683,728

[22] Filed: May 6, 1976

[51] Int. Cl.[2] ..... B05C 11/08; A47L 5/38

[52] U.S. Cl. ..... 118/50; 15/307

[58] Field of Search ..... 118/50, 50.1, 106, 63; 15/307

[56] References Cited

U.S. PATENT DOCUMENTS

| | | | |
|---|---|---|---|
| 1,759,804 | 5/1930 | Pieron | 15/307 X |
| 1,939,578 | 12/1933 | Sullivan | 15/307 |
| 1,954,098 | 4/1934 | Powers | 118/50 X |
| 2,174,744 | 10/1939 | Hill | 118/50 UX |
| 2,792,587 | 5/1957 | Rose et al. | 15/307 |
| 3,742,734 | 7/1973 | Fleissner | 15/307 X |
| 3,848,439 | 11/1974 | Lopata | 118/50 X |
| 3,969,780 | 7/1976 | Henderson | 118/50 X |

FOREIGN PATENT DOCUMENTS

| | | | |
|---|---|---|---|
| 122,134 | 2/1959 | U.S.S.R. | 118/50 |

*Primary Examiner*—James Kee Chi

*Attorney, Agent, or Firm*—Earle R. Marden; H. William Petry

[57] ABSTRACT

This invention relates to an apparatus to apply a coating to a fabric which employs vacuum pressure to enhance the penetration of the coating into the fabric. The vacuum pressure source has a continuously moving surface to prevent build-up of the coating material at the outlet of the vacuum source.

3 Claims, 3 Drawing Figures

VACUUM SLOT COATING APPARATUS

The object of the invention is to provide a means to coat a fabric using vacuum pressure to enhance penetration of the fabric.

Other objects and advantages of the invention will become readily apparent as the specification proceeds to describe the invention, with reference to the accompanying drawings, in which.

Figure 1:
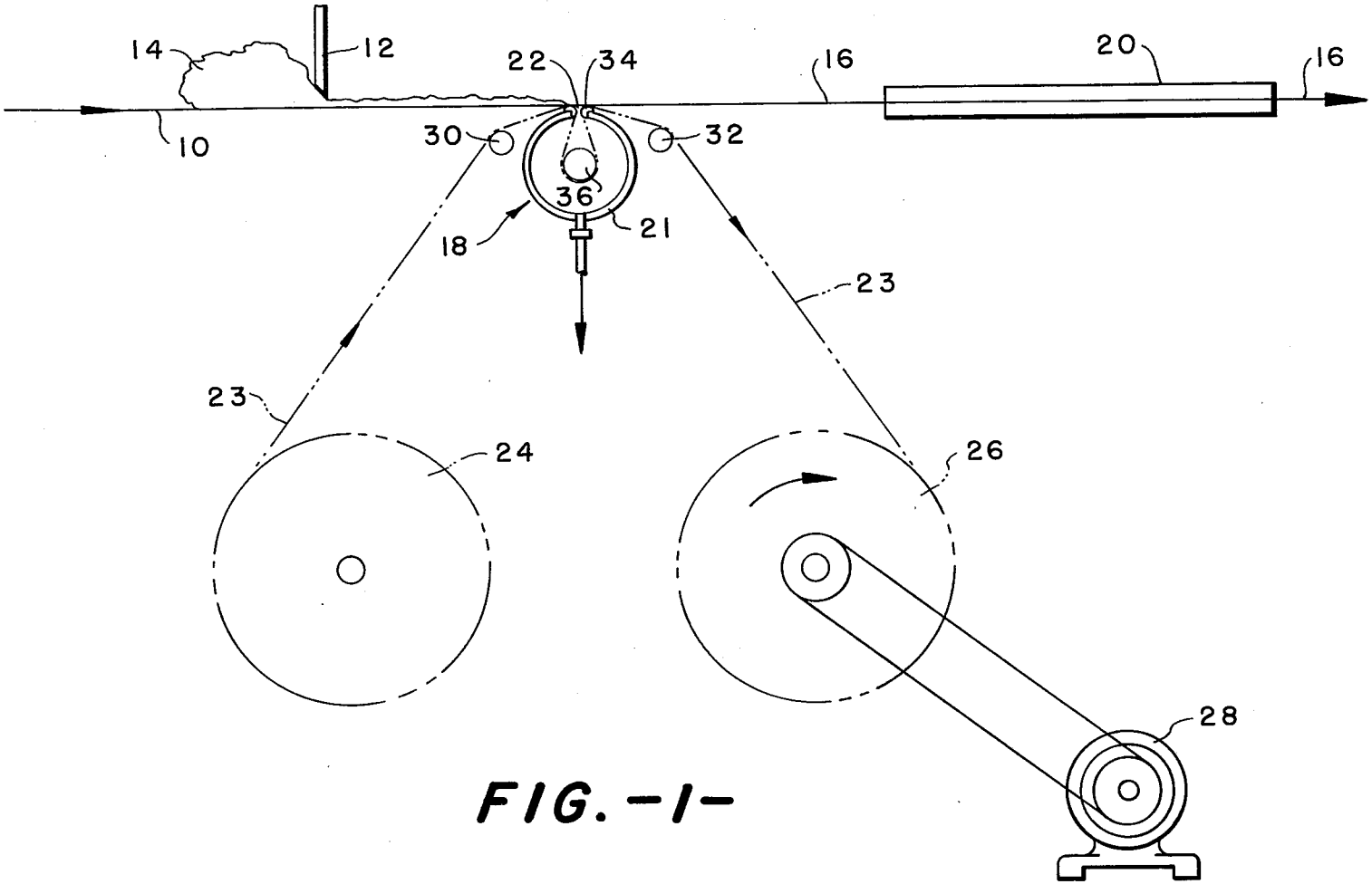
FIG. 1 is a schematic view of the new and improved coating machine.
Figure 2:
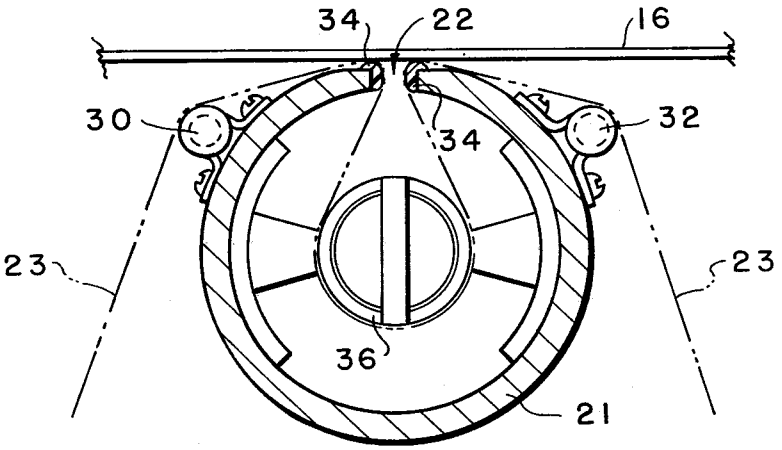
FIG. 2 is a blown-up cross-section view of the vacuum applying apparatus.
Figure 3:
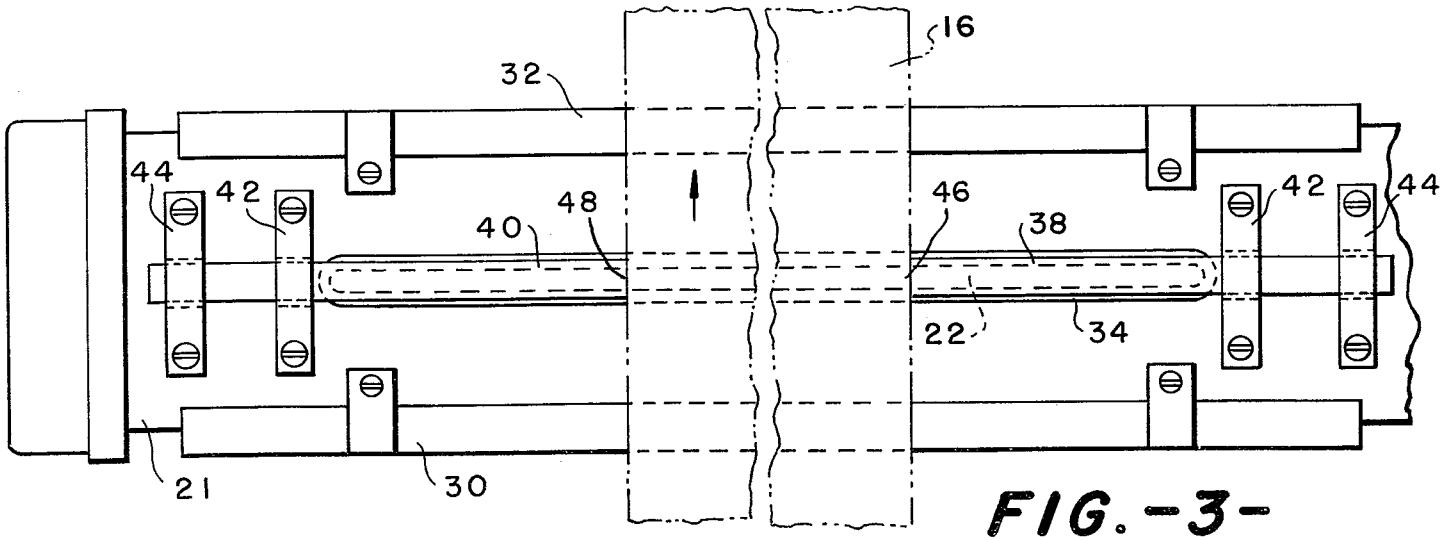
FIG. 3 is a partial top view of the FIG. 2.

Looking now to FIG. 1, the reference number 10 represents a woven, knitted or other fabric to be coated. The fabric passes successively under the knife or doctor blade 12 whereat the coating material 14, such as latex foam, is applied to the fabric and then over the vacuum manifold 18 to the curing station where the fabric is dried and cured. The coated fabric 16 is then taken-up on a take-up device, not shown.

The vacuum manifold 18 is mounted in a fixed position under the path of travel of the coated material 16 and due to the suction or subatmospheric pressure applied through the suction conduit 21 pulls the coating material into the fabric 10 to enhance the penetration thereof.

In an apparatus of this nature, the coating material, since it is still in the semi-liquid or tacky state, tends to build up on the longitudinal edges of the opening 22 of the suction manifold 21 which extends across under the width of the coated fabric 16. To prevent this build up and clean the edges of the opening 22, a moving web of material 23, preferably polyethylene, is moved continuously over the edges of the suctions opening 22 of the manifold. The polyethylene 23 is supplied from a supply roll 24 and is taken up on a take-up roll 26 driven by motor 28. In its course of travel from the supply roll 24 to the take-up roll 26 the web material passes over and is guided by the rods 30 and 32, preferably of stainless steel, mounted on the outside surface of the suction conduit 21. To enhance and ease the sliding movement of the polyethylene, a guide 34, of Delrin or other material having reduced frictional resistance, is mounted in the opening 22 to guide the web material into the opening down to the stainless steel guide rod 36 and upwardly from the rod 36 to the take-up roll 26 past the other side of the opening 22. Preferably, the relative linear speed of the coated fabric 16 to the linear speed of the web material 23 is in the order of 2500 to 1.

In manufacturing the disclosed apparatus, an opening 22 is so selected so that it is longer than the widest material to be coated in the apparatus. To adapt the apparatus to various widths of material, block-off plates 38 and 40 are mounted in suitable brackets 42 and 44 to block off that portion of the opening 22 outward from the coated fabric 16. In the preferred form of the invention, the plates 38 and 40 are tubular shaped rods which are slidably secured in brackets which have a semi-circular position to accomodate the rods and terminate, respectively, at 46 and 48 adjacent the sides of the coated material 16.

To illustrate the preferred embodiment of the invention the following sample is submitted.

EXAMPLE

A formulation is prepared by mixing about 233 pounds of Hycar 1572 × 45, a nitrile rubber latex sold by B. F. Goodrich Chemical Corporation, with an equal quantity of Dur-O-Cryl 620, an acrylic latex sold by C. S. Tanner Company, and an equal quanity of water. To this mixture are added 16 pounds of Acrysol G 110, a preneutralized carboxylated acrylic thickener sold by Rhom and Haas, 3.5 pounds of a 50/50 mixture of water and Stabilizer 30, an ammonium stearate paste sold by C. S. Tanner Company, 3.5 pounds of Equex S, an alkyl sulfate sold by Proctor and Gamble, and 2.5 pounds of Aurasperse W-1021, a yellow oxide pigment sold by The Harshaw Chemical Company. The resulting latex formulation containing about 30% solids has a viscosity of about 1,000 centipoises as measured on a Brookfield RVF Viscosimeter using spindle No. 2 at 10 rpm.

A foam is prepared from the resulting latex by passing it through a mechanical foamer to form a foam having a specific gravity of approximately 0.1 and pH of about 5.0. The resulting foam is applied to a woven fabric of about 60 inches width yielding approximately 1.35 linear yards per pound and having a cotton fill and a 75/25 polyester/cotton warp. The fabric is a banana color with a dense long nap and a fabric thickness of approximately 26 mils.

The foam coated fabric is moved at a rate of about 30 yards per minute over a plate above which is located a knife to control the thickness of the foam on the fabric. The speed of the polyethylene web material 23 is about 2 feet per hour and has a thickness of about 10 mils. The knife edge is positioned 55 mils vertically above the fabric and 75 mils horizontally off the edge of the plate. The fabric is then passed over a transversely positioned vacuum slot with an opening of 150 mils located approximately 20 inches from the knife. A vacuum of about 5 inches is applied to the fabric to draw a portion of the foam into the fabric structure. Thereafter, the fabric is dried and cured by passing it through an oven 20 at 325° F. for slightly more than one minute.

The fabric is sanded with Number 220 grit on a Curtin-Hebert sander and then printed with a random, darker beige pattern to increase its visual similarity to natural leather. A urethane finish of waxy touch is applied to the fabric and the fabric is run through a rubber belt compactor at 270° F. to change the break, softness and surface hand thereof. The resulting product can be cut and sewn to form garments with the appearance of a fine chamois leather and the hand, drape and recovery of the natural material. The garments are comfortable to wear since they have a high degree of air permeability. Also, the garments can be laundered without adversely affecting their appearance.

Although the preferred embodiment has been described specifically, it is contemplated that changes may be made without departing from the scope or spirit of the invention and it is desired that the invention be limited only by the scope of the claims.

That which is claimed is:

1. In a apparatus to provide a coated fabric having means to coat a fabric, suction conduit means having an elongated opening thereon to apply suction pressure to the fabric to impregnate the coating into the fabric and means to cure the coated fabric the movement comprising: guide means mounted inside said conduit means to guide a web material across one side of said elongated opening into said suction conduit means and out across the other side of said elongated opening to clean the surface of said opening, said opening being lined with a friction resistant material.

2. The apparatus of claim 1 wherein block-off members are mounted on said suction conduit means over a portion of said elongated opening to block-off said elongated opening beyond the edges of the coated fabric.

3. The apparatus of claim 1 wherein said guide means includes a roll member.

* * * * *

UNITED STATES PATENT OFFICE

CERTIFICATE OF CORRECTION

Patent No. 4,044,716 Dated August 30, 1977

Inventor(s) Dennis L. Riddle

It is certified that error appears in the above-identified patent and that said Letters Patent are hereby corrected as shown below:

Column 2, line 67, insert the word --suction-- between "said" and "conduit".

Signed and Sealed this

*Sixth* Day of *June 1978*

[SEAL]

*Attest:*

RUTH C. MASON
*Attesting Officer*

DONALD W. BANNER
*Commissioner of Patents and Trademarks*